United States Patent [19]

Wygant

[11] 4,130,299

[45] Dec. 19, 1978

[54] LOW-ODOR DYE SOLVENTS FOR PRESSURE-SENSITIVE COPYING SYSTEMS

[75] Inventor: James C. Wygant, Creve Coeur, Mo.

[73] Assignee: Monsanto Company, St. Louis, Mo.

[21] Appl. No.: 832,698

[22] Filed: Sep. 12, 1977

[51] Int. Cl.[2] ..... B41M 5/16; B41M 5/22

[52] U.S. Cl. ..... 282/27.5; 427/145; 427/150; 427/261; 428/307; 428/323; 428/914

[58] Field of Search ..... 282/27.5; 252/316; 428/307, 914, 323; 427/145, 146, 150, 151, 261

[56] References Cited

U.S. PATENT DOCUMENTS

| | | | |
|---|---|---|---|
| 3,663,256 | 5/1972 | Miller et al. | 282/27.5 |
| 3,836,383 | 9/1974 | Kiritani et al. | 428/307 |
| 3,901,986 | 8/1975 | Brockett et al. | 428/411 |
| 3,996,405 | 12/1976 | Porter | 428/307 |
| 4,003,589 | 1/1977 | Konishi et al. | 282/27.5 |

*Primary Examiner*—Thomas J. Herbert, Jr.

*Attorney, Agent, or Firm*—S. M. Tarter; E. P. Grattan; P. D. Matukaitis

[57] ABSTRACT

Solvents useful to dissolve dyes employed in pressure-sensitive copying systems comprise compositions of monobenzylated, dibenzylated and, optionally, tribenzylated xylenes having defined isomeric configurations. Benzylated meta-xylene; benzylated para-xylene; and benzylated meta-para-xylene are low-odor solvents.

12 Claims, No Drawings

LOW-ODOR DYE SOLVENTS FOR PRESSURE-SENSITIVE COPYING SYSTEMS

BACKGROUND OF THE INVENTION

1. Field of the Invention

This invention relates to pressure-sensitive copying systems, e.g., the kind in which a substantially colorless color former (dye) held within microcapsules is reacted, upon rupturing of the microcapsules by an applied pressure, with a co-reactant material to form distinctive colored marks. More particularly, the present invention relates to improved dye solvents useful in pressure-sensitive copying systems.

2. Description of the Prior Art

In one conventional pressure-sensitive copying system, the microcapsules are carried on one surface of a transfer sheet, referred to as a CB (coated back) sheet and the co-reactant material is carried on one surface of a record sheet, referred to as a CF (coated front) sheet. In another embodiment, the microcapsules and the co-reactant material are carried on the same surface of a single sheet. In systems for making a plurality of copies, intermediate CFB (coated front and back) sheets are provided. The sheets are usually made of paper.

Most known CB sheets carry a coating of microcapsules, which may be separate or in capsular units, i.e., clusters of capsules. Each microcapsule comprises a wall of hydrophilic colloid material such as gelatin, containing a substantially colorless chromogenic material (color former) of basic reactant chemical properties which, in use, contacts and is colored by a co-reactant material.

The co-reactant material is typically a finely divided acidic compound which is also substantially colorless in its natural form. Commonly used co-reactant materials include organic polymers and inorganic clays which are applied to the CF sheet in a suitable paper coating binder material such as starch, casein, polymer or latex.

Distinctive colored marks occur on the CF sheet following rupture of the microcapsules through localized pressure from writing, typing or printing on the noncoated front surface of a CB sheet which is positioned with its coated back surface in contact with the coated front surface of a CF sheet.

The substantially colorless color former produces color only under acidic conditions, that is, upon contact with the acidic co-reactant of the CF sheet. The color former is always dissolved in a solvent and, in many cases, is diluted with kerosene or the like. It is therefore important that the color former solution possess the required physical and chemical properties.

Generally desirable properties of the color former solutions are that it be easily encapsulated by conventional techniques; that it have good shelf life in the encapsulated form; and that it be stable at moderately elevated temperatures. It is also important that the mark produced as a result of the reaction between the color former and the co-reactant develop rapidly, be fade resistant and be resistant to bleeding or feathering as a result of capillary action or other surface phenomena.

The dye solvent (color former solvent) functions to provide a carrier for the color former and a medium for the reaction between the color former and the acidic co-reactant material. The solvent must be capable of holding the color former in solution within the microcapsule, of carrying the color former to the sensitized surface of the CF sheet when the microcapsule is ruptured, and of promoting or at least not inhibiting color development with the co-reactant. In addition, since inadvertent rupture of the microcapsule is possible by careless handling, the solvent must be noninjurious to skin, clothing or environment.

The solvent is an important factor in determining the performance of the pressure-sensitive copying system in terms of stability of the sheets to heat and storage time, rate of color development, extent of color development, and durability of image. Certain prior art dye solvents have exhibited adequate print speed and color intensity on the widely used phenolic resin-coated CF sheets. In some cases, however, objectionable odors in the copying system have been ascribed to the dye solvent itself. Such odors obviously detract from commercial acceptance of such copying systems even though the dye solvent performance is otherwise superior.

While considerable care is naturally given to avoidance of dye solvents having marginal or detrimental odor properties, there are several reasons why the selection process is neither orderly, predictable or scientific. For example, the inherent odor characteristics of a given aromatic hydrocarbon designated as a primary dye solvent may either be improved or worsened depending upon the type and quantity of diluent employed therewith.

A given aromatic hydrocarbon may have an odor deemed acceptable by average sensory standards yet may cause discomfort in a poorly-ventilated room containing massive quantitities of pressure-sensitive paper using that same hydrocarbon as the dye solvent. Thus, the odor effects become cumulative especially in areas where these paper systems are stored in permanent files. Even the use of odor maskants has, in some cases, been found to be an ineffective corrective measure.

Many nonhalogenated aromatic hydrocarbons are known to the art as dye solvents for pressure-sensitive copying systems. Among these are diaryl alkanes, triaryl dialkanes, alkylated biphenyls, alkylated terphenyls, partially hydrogenated terphenyls, alkylnaphthalenes, benzylnaphthalenes and benzyl aryl ethers. It is apparent from the prior art, however, that the guidelines for odor classification of the aforementioned aromatic hydrocarbons are neither well established nor widely applicable.

U.S. Pat. No. 4,003,589, which issued Jan. 18, 1977, discloses certain alkylnaphthalenes said to be useful as dye solvents. In defining the alkylation levels for obtaining optimum performance, the patentees state that the odor will be undesirable if the total number of carbon atoms in the substituted alkyl groups is smaller than 4.

In U.S. Pat. No. 3,836,383, which issued Sept. 17, 1974, there are disclosed certain diphenylalkanes useful as dye solvents. The patentees state that the usual aromatic hydrocarbons do not satisfy the odor requirements established for a suitable dye solvent. Each of the diphenylalkane compounds exemplified in U.S. Pat. No. 3,836,383, regardless of type or location of alkyl substitution in the rings, was said to not have the unpleasant smell associated with polychlorinated diphenyls of the prior art.

U.S. Pat. No. 3,996,405, which issued Dec. 7, 1976, discloses certain ethyldiphenylmethanes useful as dye solvents. The ethyl group in the one benzene ring is said by the patentee to be attachable at the ortho, meta or para positions with equal performance. Thus, no recognizable advantage was seen through selective isomer positioning.

U.S. Pat. No. 3,627,581 which issued Dec. 14, 1971, discloses isopropylbiphenyl as a dye solvent. The isopropyl group, according to the patentee, may be attached to the benzene ring at the ortho, meta or para positions. Some performance preference was seen, however, for the meta and para isomers versus the ortho isomer of isopropylbiphenyl. No distinction was stated, nor did the patentee give attention to, the odor characteristics of isomer variations of isopropylbiphenyl.

Thus, while certain classes of aromatic hydrocarbons have recently been identified as outstanding performers as dye solvents in pressure-sensitive copying systems, there still remains a lack of understanding of routes to odor improvement. Upgrading of print intensity and fade resistance is exemplified in aforementioned U.S. Pat. No. 3,996,405 wherein ethyldiphenylmethane is said to be superior to isopropylbiphenyl, the latter described in U.S. Pat. No. 3,627, 581. Odor improvements in alkylated diphenylmethanes such as ethyldiphenylmethane would constitute a step forward in the dye solvent art.

It is an object of the present invention, therefore, to provide certain alkylated diphenylmethanes which have been found to exhibit surprisingly superior odor characteristics together with print performance essentially equivalent to ethyldiphenylmethane. Further objects of this invention will become apparent from the following description and examples.

SUMMARY OF THE INVENTION

For reasons not fully understood, it has been found that certain monobenzylated, dibenzylated and, optionally, polybenzylated compositions of certain isomers of xylene are superior dye solvents characterized by surprisingly low odor compared to similar aromatic molecules. Only benzylated meta, para and meta-para xylene compositions are found to exhibit the low-odor properties. For unexplained reasons, benzylated ortho-xylene compositions do not exhibit the beneficial odor characteristics.

The low-odor dye solvents of this invention which are useful in pressure-sensitive copying systems comprise a composition selected from the group consisting of:

(a)

(i) at least about 70 percent by weight of:

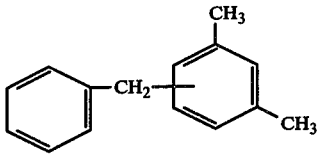

(ii) from about 10 to about 25 percent by weight of:

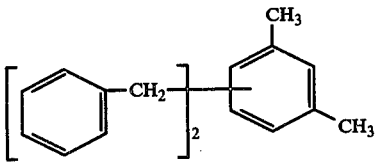

(iii) from 0 to about 6 percent by weight of:

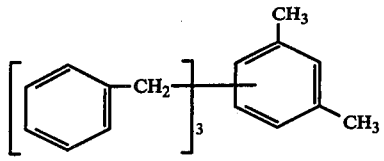

(b)

(i) at least about 65 percent by weight of:

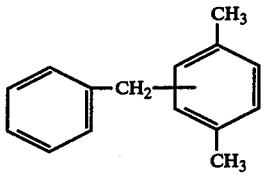

(ii) from about 15 to about 30 percent by weight of:

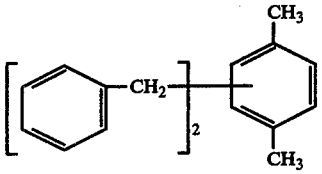

(iii) from 0 to about 8 percent by weight of:

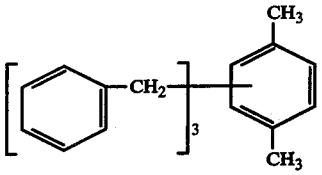

and (c) isomeric or physical mixtures of (a) and (b).

DESCRIPTION OF PREFERRED EMBODIMENTS

The pressure-sensitive copying systems utilizing the improved dye solvents of the present invention may be prepared according to well-known conventional procedures. Descriptions of methods for preparing the CB sheet and the CF sheet are to be found in the literature and such methods do not constitute a part of the present invention. Coating of the coreactant material, whether inorganic clay or organic polymer type, is conducted according to such established procedures. Similarly, formation and application of microcapsules onto the CB sheet is fully disclosed in the literature. The solvents of this invention may be substituted for conventional dye solvents in order to produce improved pressure-sensitive copying systems according to such conventional procedures.

The solvents of the present invention are preferably utilized in combination with one or more of several conventional color formers of normally colorless form. One such class of color formers comprises colorless aromatic double bond organic compounds which are converted to a more highly polarized conjugated and colored form when reacted with an acidic sensitizing material on the CF sheet. A particularly preferred class of color formers includes compounds of the phthalide type such as crystal violet lactone (CVL) which is 3,3-bis(p-dimethyl-aminophenyl)-6-dimethylaminophthalide and malachite green lactone which is 3,3-bis(p-dimethylaminophenyl)phthalide. Other phthalide derived color formers include 3,3-bis(p-m-dipropylaminophenyl)phthalide, 3,3-bis(p-methylaminophenyl)phthalide, 3-(phenyl)-3-indole-3-yl)phthalides such as 3-(p-dimethylaminophenyl)-3-(1,2-dimethylindol-3-yl)phthalide, 3,3-bis(phenylindol-3-yl)phthalides such as 3,3-bis(1,2-dimethylindol-3-yl)phthalide, 3-(phenyl)-3-(heterocyclic-substituted)phthalides such as 3-(p-dimethylaminophenyl)-3-(1-methylpyrr-2-yl-6-dimethylaminophthalide, indole and carbazole-substituted phthalides such as 3,3-bis(1,2-dimethylindol-3-yl)-5-dimethylaminophthalide and 3,3-bis(9-ethylcarbazol-3-yl)-5-dimethylaminophthalide, and substituted indole phthalides such as 3-(1,2-dimethylindol-3-yl)-3-(2-methylindol-3-yl)phthalide.

Other color formers also useful in the practice of this invention include indole substituted pyromellitides such as 3,5-bis(p-dimethylaminophenyl)-3,5-bis(1,2-dimethylindol-3-yl)pyromellitide, 3,7-bis(p-diethylaminophenyl)-3,7-bis(1,2-dimethylindol-3-yl)pyromellitide, 3,3,7,7-tetrakis-(1,2-dimethylindol-3-yl)pyromellitide and 3,3,5,5-tetrakis-(1,2-dimethylindol-3-yl)pyromellitide; and leucauramines and substituted leucauramines such as p-xylyl-leucauramine and phenyl-leucauramine. Also included are orthohydroxybenzoacetophenone, 2,4-bis[p-(p-dimethylaminophenylazo)aniline]-6-hydroxy-symtrazine, N,3,3-trimethylindolinobenzospiropyrans, and N,3,3-trimethyl-indolino-$\beta$-naphthospiropiranes.

An auxiliary coloring agent can be employed with the above color formers to provide fade resistance where fading is a problem. Many phthalide compounds such as crystal violet lactone for example, are characterized by rapid color development with a normal tendency to fade during the course of time. One suitable auxiliary coloring agent is benzoyl leuco methylene blue which oxidizes when released on the paper to slowly form a permanent blue color. The combination of a phthalide color former and such a colorless oxidizable auxiliary coloring agent provides a composition having both rapid color development and fade resistance.

The low-odor dye solvents of this invention are compositions containing monobenzylated, dibenzylated and, optionally, tribenzylated xylenes having defined isomeric configurations. Only mixtures of benzylated meta-xylene, mixtures of benzylated para-xylene, and mixtures of meta-para-xylenes have been found to exhibit suitably low odor to be superior dye solvents useful in pressure-sensitive copying paper systems. Similar compositions of benzylated ortho-xylene did not exhibit suitably low odor.

Monobenzylated meta-xylene is represented by the structure:

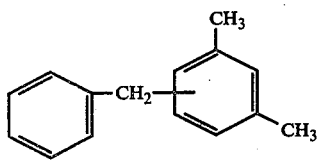

Monobenzylated para-xylene is represented by the structure

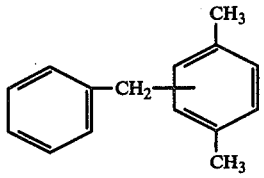

The solvents of this invention which are liquids at room temperature must be used alone or in combination with diluents. Solvents which are solids or semisolids at room temperature must necessarily be used in combination with another material, hereinafter referred to as a diluent, in order to provide a mixture having the requisite degree of liquidity for use in pressure-sensitive recording paper systems. For purposes of this invention the term "diluent" includes both inert or substantially inert materials which are of little practical use alone as dye solvents either because they have poor solvating power for the chromogen or because they act in some way to inhibit the development of color, as well as some more active materials such as aromatic organic compounds which may be useful by themselves as dye solvents.

Either type of diluent may be used in combination with the solvents of this invention. For example, a solvent may be admixed with from 0 to about 3 parts of a diluent for each part of solvent wherein the diluent is a mineral or vegetable oil, such as kerosene, paraffin oil, mineral spirits, castor oil, neatsfoot oil, sperm oil, lard oil, olive oil, soybean oil, cottonseed oil, coconut oil, or rapeseed oil, or an organic aryl compound such as aromatic naphtha, $C_{1-12}$ alkyl benzene, benzyl biphenyl, or $C_{1-6}$ alkylaryl indane. Biodegradable monoalkylbenzene mixtures, sometimes called "alkylates", are particularly useful as diluents with dye solvents of this invention. Such alkylates are commercially available as intermediates for the manufacture of anionic liquid and solid detergents. Typical is a mono-$C_{10}$ to $C_{15}$ alkylbenzene mixture.

The diluents referred to herein function to alter physical properties of the solvent such as viscosity or vapor pressure as may be desired for handling or processing considerations. The diluents may also serve to reduce the total cost of the solvent in the system and to enhance in some instances the performance of the solvent particularly with respect to speed of color development or resistance to fade.

The solvents may also contain certain additives specifically intended to alter or control the final properties of the fluid as for example viscosity control agents, vapor pressure control agents, freezing point depressants, odor masking agents, antioxidants, colored dyes and the like.

In a preferred embodiment of the present invention, the chromogenic material (color former) is dissolved in a selected solvent to form a marking liquid which is reactive with the acidic solid coreactant material. The acidic material can be any compound within the definition of a Lewis acid, i.e., an electron acceptor with reference to the chromogen, which promotes the polarization of the chromogen into a colored form. The solid acidic material further serves as an adsorbent of the marking fluid to receive the transferred image. Commonly used acidic materials include acid clays and acidic organic polymeric materials such as phenolic polymers, phenolacetylene polymers, maleic acid-rosin resins, partially or wholly hydrolyzed sytrene-maleic anhydride copolymers and ethylene-maleic anhydride copolymers, carboxy polymethylene and wholly or partially hydrolyzed vinyl methyl ether, maleic anhydride copolymer and mixtures thereof. Superior results are achieved herein with the phenolic type acidic materials, i.e., phenolic resin CF sheet.

The dye solvents of this invention, with or without the presence of a diluent, and in admixture with the chromogenic material (color former), are usually microencapsulated according to procedures well-known and broadly described in the art. The microcapsules are typically coated onto one surface of a CB sheet and the acidic coreactant (electron accepting) material is carried on one surface of the CF sheet.

While microencapsulation is the most familiar means for isolating the dye solvent from one or both of the color-producing reactants in the system, it should be understood that alternate means are known to the art. Thus, the dye solvent can be associated with the chromogenic and acidic coreactants of the system by either being in close proximity to both coreactants or by having one of the coreactants dissolved therein and being in close proximity to the other.

Thus, capsule raw materials and capsule manufacture are not critical to this invention. Suitable microcapsules may be made according to the procedures taught in U.S. Pat. No. 2,800,457 (July 23, 1957) and U.S. Pat. No. 3,041,289 (June 26, 1962). Other methods of isolating the marking droplets are also applicable here, such as entrapment of the droplets in a dried emulsion film.

Suitable procedures for making capsule-coated record sheets are taught in U.S. Pat. No. 2,711,357 (June 21, 1955); U.S. Pat. No. 2,712,507 (July 5, 1955) and U.S. Pat. No. 2,730,456 (Jan. 10, 1956).

Examples of phenol-aldehyde resins which can be used as electron accepting materials to develop the color of the chromogenic material are disclosed in U.S. Pat. No. 3,672,935. Other useful phenolic resins are disclosed in U.S. Pat. No. 3,663,256.

Still further useful phenol-aldehyde resins are oil-soluble metal salts of phenol-aldehyde novolak resins, for example, the zinc salt of para-octylphenol-formaldehyde resin disclosed in U.S. Pat. No. 3,732,120.

The dye solvent compositions of this invention can be prepared by benzylation of meta-xylene, para-xylene or mixed meta-para-xylene, as the case may be, with an aluminum chloride-nitromethane catalyst. Benzylation is customarily achieved by employing benzyl chloride as a reactant.

The following several Examples illustrate the preparation of benzylated xylene compositions having predetermined isomeric configurations. All parts and percentages are by weight unless otherwise specified.

EXAMPLE 1

To a three liter flask were charged 1274 grams (12 moles) of meta-xylene of 98.5% minimum purity; 4.8 grams 0.036 moles) of aluminum chloride; 4.24 milliliters of nitromethane; and then gradually 506.4 grams (4 moles) of benzyl chloride. The reactor contents was then heated to about 70° C. for 90 minutes with agitation. The reactor contents was washed with 500 ml. of 5% sodium hydroxide and 500 ml. of water. The mixture was then stripped through a 25.4 centimeter Vigreaux column to remove excess xylene. Gas chromatographic analysis of the residue revealed a benzylated meta-xylene composition having the following constitution:

80.9% Monobenzylated meta-xylene
17.6% Dibenzylated meta-xylene
1.5% Tribenzylated meta-xylene This benzylated meta-xylene composition exhibited an initial boiling point of 180° C. at 730 mm. Hg vacuum and a refractive index at 25° C. of 1.5742.

EXAMPLE 2

To a three liter flask were charged 1274 grams (12 moles) of para-xylene of 98.5% minimum purity; 4.8 grams (0.036 moles) of aluminum chloride; 4.24 milliliters of nitromethane; and then gradually 506.4 grams (4 moles) of benzyl chloride. Following the same procedure of Example 1 above, a benzylated para-xylene composition was obtained having the following chromatographic analysis:

73.9% Monobenzylated para-xylene
22.6% Dibenzylated para-xylene
3.5% Tribenzylated para-xylene This benzylated para-xylene composition exhibited an initial boiling point of 179° C. at 730 mm. Hg vacuum and a refractive index at 25° C. of 1.5788.

EXAMPLE 3

To a three liter flask were charged 1274 grams (12 moles) of ortho-xylene of 98.5% minimum purity; 4.8 grams (0.036 moles) of aluminum chloride; 4.24 milliliters of nitromethane; and then gradually 506.4 grams (4 moles) of benzyl chloride. Again following the procedure of Example 1, a benzylated orthoxylene composition was obtained having the following chromatographic analysis:

73.8% Monobenzylated ortho-xylene
23.4% Dibenzylated ortho-xylene
2.8% Tribenzylated ortho-xylene This benzylated ortho-xylene composition exhibited an initial boiling point of 185° C. at 730 mm. Hg vacuum and a refractive index at 25° C. of 1.5797.

EXAMPLE 4

The mixed xylene used in this Example is a typical commercial xylene and contains about 20% each of ortho- and para-xylenes, about 40% meta-xylene and about 20% ethylbenzene.

To a suspension of 7 grams of aluminum chloride in 2012.4 grams of the commercial mixed xylene was gradually added 890 grams of benzyl chloride, following the procedure described above. A benzylated mixed isomeric xylene product was obtained having the following chromatographic composition:

83% Monobenzylated mixed-xylenes
16% Dibenzylated mixed-xylenes
About 1% Tribenzylated mixed-xylenes The product exhibited an initial boiling point of 135° C. at 758 mm. Hg vacuum and a refractive index at 25° C. of 1.5740.

EXAMPLE 5

Using the same procedure as in Example 1, a meta-paraxylene starting material was employed in place of pure meta-xylene. The meta-para-xylene feed contained about 68% meta isomer; about 28% para isomer; 1% or less of ortho isomer; the balance being ethylbenzene.

The benzylated meta-para-xylene product of the reaction exhibited an initial boiling point of 178° C. at 730 mm. Hg vacuum. Its refractive index at 25° C. was 1.5773. The nominal ratio of mono- to dibenzylated components in the reaction product was 75:25.

Odor characteristics were determined for each of the respective benzylated xylene compositions prepared in Examples 1–5 above. As a reference or control fluid, a known prior art diphenylmethane composition was employed. Specifically, the control fluid was a benzylated ethylbenzene mixture of the type described in U.S. Pat. No. 3,996,405. Its refractive index at 25° C. was 1.5745. Chemical constitution of the control fluid utilized herein was:

74% Monobenzylated ethylbenzene
22% Dibenzylated ethylbenzene
4% Tribenzylated ethylbenzene Qualitative comparisons of odor were made according to the following procedure. Liberal quantities of each fluid were applied to separate pieces of ordinary letter-size bond paper. The fluid-impregnated paper specimens were then crumpled and individually placed within closed glass jars. After allowing the specimens to stabilize their odor emission within the closed jars, each jar was sequentially opened to permit odor comparison of the contents by a three-person odor evaluation panel. Each dye solvent composition was evaluated "neat" and also as a 3:1 blend with a kerosene-type diluent. No significant difference in odor was perceived between a neat and a diluted sample of a given composition. Qualitative results are presented in the following Table I wherein the reference or control fluid was the aforementioned benzylated ethylbenzene composition of the type described in U.S. Pat. No. 3,996,405.

TABLE I

| ODOR COMPARISON | | |
|---|---|---|
| Dye | | Odor Compared |
| Solvent | Dye Solvent Composition | to Control Solvent |
| Control | Benzylated ethylbenzene mixture | — |
| Ex. 1 | Benzylated meta-xylene mixture | Substantially better |
| Ex. 2 | Benzylated para-xylene mixture | Substantially better |
| Ex. 3 | Benzylated ortho-xylene mixture | No better |
| Ex. 4 | Benzylated mixed ortho-meta-xylene mixture | No better |
| Ex. 5 | Benzylated meta-para-xylene | Substantially better |

The results in Table I above clearly demonstrate a surprisingly beneficial odor associated with only the meta, the para, and the meta-para, but not the ortho, isomer compositions of benzylated xylene.

To insure that the low-odor dye solvent compositions of this invention were not deficient in other essential performance characteristics, the rate and extent of color development of these low-odor solvents was compared to the benzylated ethylbenzene control composition.

The laboratory procedure employed herein consisted of preparing a marking fluid comprising a solution of a chromogen (color former) in the solvent or solvent composition to be tested, applying the fluid to CF paper coated with a phenolic resin coreactant material, and measuring the print speed and color intensity.

In the test procedure the marking fluid was prepared by adding sufficient crystal violet lactone color former to the dye solvent to achieve 1.5 weight percent concentration of the color former. This was followed by agitation and warming to 100°–120° C. if necessary to achieve solution. The solution was then cooled to room temperature, seeded with a few crystals of the color former, and allowed to stand for several days with occasional shaking to assure that the solution was not super-saturated.

The solvent/color former solution was thereupon saturated into a blotter. The blotter was daubed 7 times with a pencil eraser. The material on the pencil eraser, approximately 1 microliter of the solvent/color former solution, was transferred to a phenolic resin CF sheet and color intensity was measured.

A Macbeth digital read-out Reflection Densitometer was employed, using filters for color, to measure optical density. The optical density measurements obtained from the Reflection Densitometer were seen visually and were recorded on a Sanborn recorder which plots optical density versus time.

Print speed is defined herein as the time (in seconds) from application of the solvent/color former solution until an optical density of 40 is achieved on the CF sheet. It has been found difficult to visually distinguish color change above a value of 40.

Color intensity for each of the samples tested was derived from the recording at a defined elapsed time. Higher readings signify darker color.

The results of tests evaluating low-odor dye solvents of this invention in comparison to the benzylated ethylbenzene control solvent are presented in Table II which follows. The specific materials presented in Table II are for purposes of illustration only and the present invention is not to be limited thereto.

TABLE II

| | | PHENOLIC RESIN OF SHEET | | | |
|---|---|---|---|---|---|
| Example No. | Dye Solvent Composition | Print Speed (seconds) | Color Intensity at 15 seconds | at 30 seconds | at 60 seconds |
| Control | 100% Benzylated ethylbenzene | 5 | 70 | 72 | 4 |
| 1 | 100% Benzylated meta-xylene | 6 | 64 | 68 | 70 |
| 2 | 100% Benzylated para-xylene | 7 | 64 | 70 | 72 |
| 5 | 100% Benzylated meta-para-xylene | 5 | 66 | 70 | 72 |

The print speed results in Table II above illustrate the comparable performance obtained with the low-odor solvents within the scope of this invention. Print speed for those low-odor solvents was suitably fast and color intensity was desirably high. A desirable stabilized color intensity value for this laboratory procedure is 50. With reference to the dye solvent compositions described in Table II above, the recitation of crystal violet lactone dye (chromogen) within the compositions was omitted from the percentage numbers solely for convenience of expression. No diluent was employed.

Although a preferred embodiment of this invention comprises a two-sheet system wherein the acidic receiving material is carried by one sheet and a marking fluid comprising a chromogen and solvent is carried by a second sheet, the marking fluid being released onto the acidic material by the application of pressure, the invention is not limited to such systems alone. The only essential requirement for a pressure-sensitive recording system is that the chromogen and the acidic sensitizing material be maintained in a separate or unreactive condition until pressure is applied to the system and that upon the application of pressure the chromogen and acidic material are brought into reactive contact. Thus it is possible to have the chromogen and acidic material present in a dry and unreactive state on a common carrier and to have the solvent alone carried on a separate sheet whereupon the application of pressure would release the solvent into the chromogen-acidic material mixture and promote localized reaction and color development. Obviously, many other arrangements, configurations and relationships of the solvent and the mark forming materials with respect to their encapsulation and location on the supporting sheet or webs can be envisioned, and such arrangements are within the scope of the present invention. For example, it is possible to coat a single paper or support member with all the components of this system to form a single self-contained unit which can be marked by the movement of a stylus or other pressure imparting means upon the surface of the paper. Such papers are particularly useful in inkless recording instruments.

A preferred low-odor dye solvent of the present invention is a benzylated meta-xylene composition comprising about 75 to about 85 percent monobenzylated component; about 15 to about 22 percent dibenzylated component; and 0 to about 5 percent tribenzylated component. Still more preferred is a benzylated meta-xylene composition containing about 80 percent monobenzylated component; about 18 percent dibenzylated component; and about 2 percent tribenzylated component.

The benzylated meta-para-xylene composition of Example 5 is illustrative of an isomeric mixture of benzylated metaxylene and benzylated para-xylene. Comparably low odor is achieved with physical mixtures of the product of Example 1 and that of Example 2.

Many variations and combinations in the application of these reactants and dye solvents to prepare pressure-sensitive recording paper systems will be apparent to and within the knowledge of those skilled in the art and will depend upon such factors as the type of chromogenic material selected, the nature of the coating to be applied and its method of application. Also deemed important are the number of supporting substrates employed and the intended application of the system. Accordingly, the present invention is not to be limited by the specific details presented in the preceding descriptions and examples.

The embodiments of the invention in which an exclusive property or privilege is claimed are defined as follows:

1. A pressure-sensitive recording system comprising
(A) supporting sheet material,
(B) mark forming components arranged in contiguous juxtaposition and supported by said sheet material, said components comprising a chromogenic material and an electron accepting material of the Lewis acid type reactive with said chromogenic material to produce a mark when brought into reactive contact, and
(C) a pressure releasable solvent for said chromogenic mark forming component, said solvent comprising a composition selected from the group consisting of:

(i)
(a) at least about 70 percent by weight of:

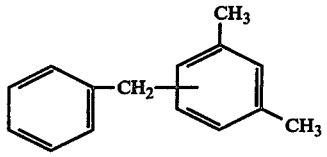

(b) from about 10 to about 25 percent by weight of:

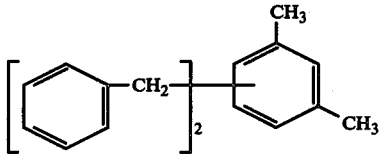

(c) from 0 to about 6 percent by weight of:

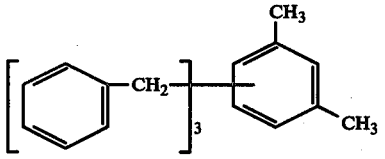

(ii)
(a) at least about 65 percent by weight of:

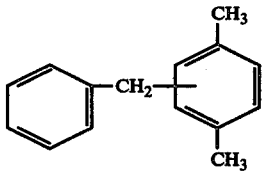

(b) from about 15 to about 30 percent by weight of:

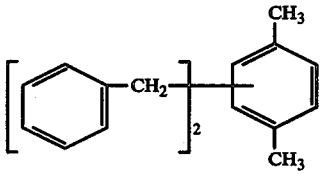

(c) from 0 to about 8 percent by weight of:

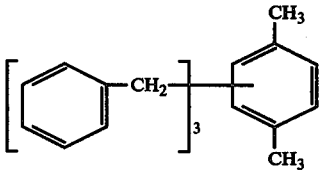

and (iii) isomeric or physical mixtures of (i) and (ii).

2. A system of claim 1 wherein the chromogenic material is dissolved in the solvent prior to bringing said chromogenic material and said electron accepting material into reactive contact.

3. A system of claim 1 wherein the mark forming components and the solvent are present on a single support paper sheet.

4. A system of claim 1 wherein the chromogenic material comprises a phthalide compound.

5. A system of claim 1 wherein the electron accepting material of the Lewis acid type is selected from the group consisting of acidic clay and acidic organic polymers.

6. A system of claim 5 wherein the electron accepting material of the Lewis acid type is a phenolic polymer.

7. A system of claim 1 wherein the solvent composition comprises:

(a) from about 75 to about 85 percent by weight of:

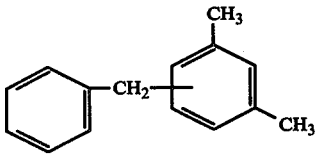

(b) from about 15 to about 22 percent by weight of:

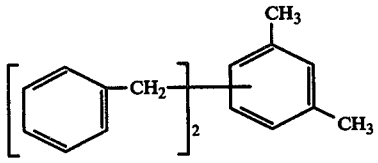

(c) from 0 to about 5 percent by weight of:

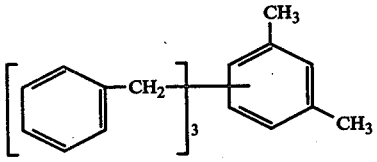

8. A system of claim 7 wherein the solvent composition contains a diluent which is a mono-$C_{10}$ to $C_{15}$-alkylbenzene mixture.

9. A pressure-sensitive recording system comprising (A) a first support sheet having disposed thereon a coating of a pressure releasable marking fluid, and (B) a second supporting sheet having disposed thereon a coating of an electron accepting material of the Lewis acid type arranged in contiguous juxtaposition with the coating on said first supporting sheet, said marking fluid comprising a solvent and a colorless or substantially colorless chromogenic material dissolved therein, said chromogenic material being reactive with said Lewis acid type material to produce a colored mark and said solvent comprising a composition selected from the group consisting of:

(i)

(a) at least about 70 percent by weight of:

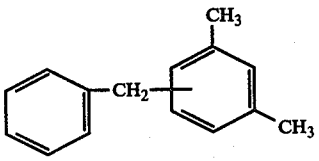

(b) from about 10 to about 25 percent by weight of:

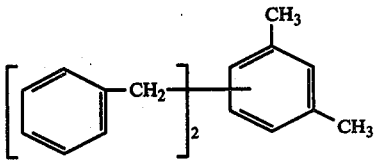

(c) from 0 to about 6 percent by weight of:

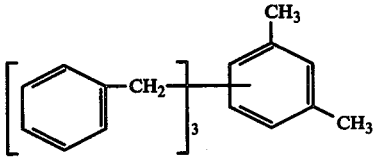

(ii)

(a) at least about 65 percent by weight of:

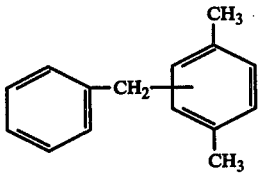

(b) from about 15 to about 30 percent by weight of:

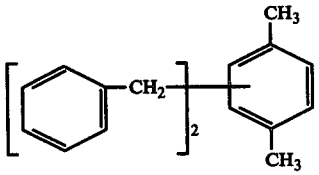

(c) from 0 to about 8 percent by weight of:

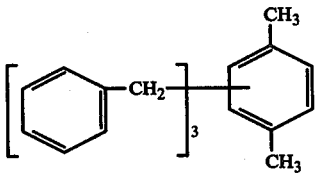

and (iii) isomeric or physical mixtures of (i) and (ii).

10. A system of claim 9 wherein the chromogenic material comprises a phthalide compound.

11. A system of claim 9 wherein the electron accepting material of the Lewis acid type is a phenolic polymer.

12. A system of claim 9 wherein the solvent composition comprises:

(a) from about 75 to about 85 percent by weight of:

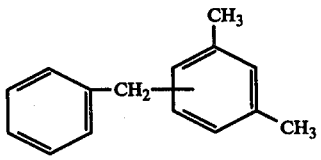

(b) from about 15 to about 22 percent by weight of:

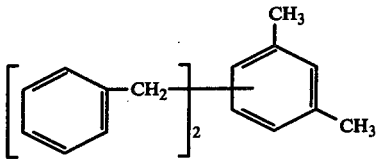
(c) from 0 to about 5 percent by weight of:
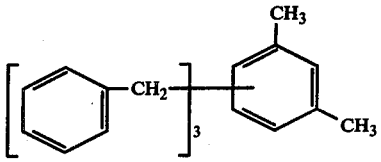
* * * * *

UNITED STATES PATENT AND TRADEMARK OFFICE

CERTIFICATE OF CORRECTION

PATENT NO. : 4,130,299

DATED : December 19, 1978

INVENTOR(S) : James C. Wygant

It is certified that error appears in the above-identified patent and that said Letters Patent are hereby corrected as shown below:

Column 9, in Table I, Ex. 4 "Benzylated mixed ortho-meta-xylene mixture" should read --- Benzylated mixed ortho-meta-para-xylene mixture ---.

Column 10, in Table II, the title "PHENOLIC RESIN OF SHEET" should read --- PHENOLIC RESIN CF SHEET ---.

Column 10, in Table II, last column, "4" should read --- 74 ---.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*